US007720568B2

(12) United States Patent
Berg et al.

(10) Patent No.: US 7,720,568 B2
(45) Date of Patent: May 18, 2010

(54) SYSTEM AND METHOD FOR MONITORED DELIVERY OF PRODUCTS

(75) Inventors: Michael D. Berg, Winfield, IL (US); Scott R. Lang, Geneva, IL (US); Liana Maria Kiff, Excelsior, MN (US)

(73) Assignee: Honeywell International Inc., Morristown, NJ (US)

( * ) Notice: Subject to any disclaimer, the term of this patent is extended or adjusted under 35 U.S.C. 154(b) by 1050 days.

(21) Appl. No.: 10/741,998

(22) Filed: Dec. 19, 2003

(65) Prior Publication Data

US 2005/0178778 A1 Aug. 18, 2005

(51) Int. Cl.
*G07F 17/00* (2006.01)

(52) U.S. Cl. ..... 700/237

(58) Field of Classification Search ..... 700/237, 700/244

See application file for complete search history.

(56) References Cited

U.S. PATENT DOCUMENTS 3,556,342 A 1/1971 Guarr
3,715,148 A 2/1973 Beals
3,914,045 A * 10/1975 Namiki et al. ..... 399/149
3,917,045 A 11/1975 Williams
4,019,793 A 4/1977 Gerding
4,267,942 A 5/1981 Wick
4,360,125 A 11/1982 Martindale
4,473,884 A 9/1984 Behl
4,635,053 A 1/1987 Banks
4,664,289 A * 5/1987 Shimizu et al. ..... 221/2
4,695,954 A 9/1987 Rose
4,783,740 A 11/1988 Ishizawa
4,785,969 A 11/1988 McLaughlin
4,811,764 A 3/1989 McLaughlin
4,847,764 A 7/1989 Halvorson
4,939,705 A 7/1990 Hamilton et al. ..... 368/10
4,942,275 A 7/1990 Addy
4,962,491 A 10/1990 Schaeffer
4,967,928 A 11/1990 Carter
5,014,875 A 5/1991 McLaughlin
5,047,948 A 9/1991 Turner
5,055,660 A 10/1991 Bertangna
5,069,511 A 12/1991 Swets
5,159,581 A 10/1992 Agans
5,259,668 A 11/1993 Teufel
5,263,596 A 11/1993 Williams
5,267,174 A 11/1993 Kaufman
5,291,191 A 3/1994 Moore
5,329,459 A 7/1994 Kaufman
5,392,952 A 2/1995 Bowden
5,412,372 A * 5/1995 Parkhurst et al. ..... 340/568.1
5,583,831 A 12/1996 Churchill et al. ..... 368/10
5,646,912 A * 7/1997 Cousin ..... 368/10
5,657,236 A * 8/1997 Conkright ..... 700/244
5,710,551 A 1/1998 Ridgeway ..... 340/870.09

(Continued)

FOREIGN PATENT DOCUMENTS

CA 2238121 A1 * 11/1998

*Primary Examiner*—Patrick Mackey
*Assistant Examiner*—Michael E. Butler
(74) *Attorney, Agent, or Firm*—Husch Blackwell Sanders Welsh & Katz

(57) ABSTRACT

A device for dispensing products senses when the respective products are accessed. A signal indicative of day and time of access can be transmitted to a remote monitoring station. Received signals can be compared to a pre-established schedule.

17 Claims, 2 Drawing Sheets

U.S. PATENT DOCUMENTS

| | | | | |
|---|---|---|---|---|
| 5,752,235 | A | 5/1998 | Kehr et al. | 705/3 |
| 5,752,621 | A * | 5/1998 | Passamante | 221/13 |
| 5,791,641 | A * | 8/1998 | Muller | 270/52.16 |
| 5,905,653 | A * | 5/1999 | Higham et al. | 700/244 |
| 6,152,364 | A * | 11/2000 | Schoonen et al. | 235/375 |
| 6,219,587 | B1 * | 4/2001 | Ahlin et al. | 700/233 |
| 6,263,259 | B1 | 7/2001 | Bartur | 700/240 |
| 6,294,999 | B1 * | 9/2001 | Yarin et al. | 340/573.1 |
| 6,332,100 | B1 | 12/2001 | Sahai et al. | 700/242 |
| 6,427,865 | B1 | 8/2002 | Stillwell et al. | 221/4 |
| 6,507,275 | B2 | 1/2003 | Romano et al. | 340/309.15 |
| 6,594,549 | B2 | 7/2003 | Siegel | 700/241 |
| 6,607,094 | B2 | 8/2003 | MacDonald | 221/121 |
| 6,611,733 | B1 * | 8/2003 | De La Huerga | 700/236 |
| 6,662,081 | B1 | 12/2003 | Jacober et al. | 700/242 |
| 6,834,775 | B1 * | 12/2004 | Collins | 221/124 |
| 7,077,286 | B2 * | 7/2006 | Shows et al. | 221/92 |
| 2004/0117062 | A1 * | 6/2004 | Bonney et al. | 700/237 |

* cited by examiner

SYSTEM AND METHOD FOR MONITORED DELIVERY OF PRODUCTS

FIELD OF THE INVENTION

The invention pertains to monitored product delivery systems. More particularly, the invention pertains to monitored medication delivery systems.

BACKGROUND

In circumstances where it is desirable or important to be able to dispense products, for example, daily in a timely manner, manual reminders such as notes and the like can be used to remind the individual or individuals who are supposed to access the products as to the schedule. At times, even in the best of the circumstances, it is difficult to remember such schedules. One particular example where many individuals interface with such schedules is in connection with taking medication. Particularly, as individuals age, they may have a medication schedule which runs from day to day on a repetitive basis, but which may require taking one or more prescription drugs in accordance with that schedule.

At times, the individual or individuals may be alone. Care givers may not be present during the times and/or days when the medications are to be taken. Nevertheless, it would be desirable to be able to track the individual's adherence to the respective schedule.

There thus continues to be a need for systems and methods of tracking adherence to product delivery schedules. Preferably, such systems and methods could carry out the desired tracking function automatically and transparently where the schedule is consistently being adhered to. In instances where there is a deviation from a preset schedule, follow up could preferably be provided relatively promptly.

DESCRIPTION OF THE PREFERRED EMBODIMENTS

Figure 1:
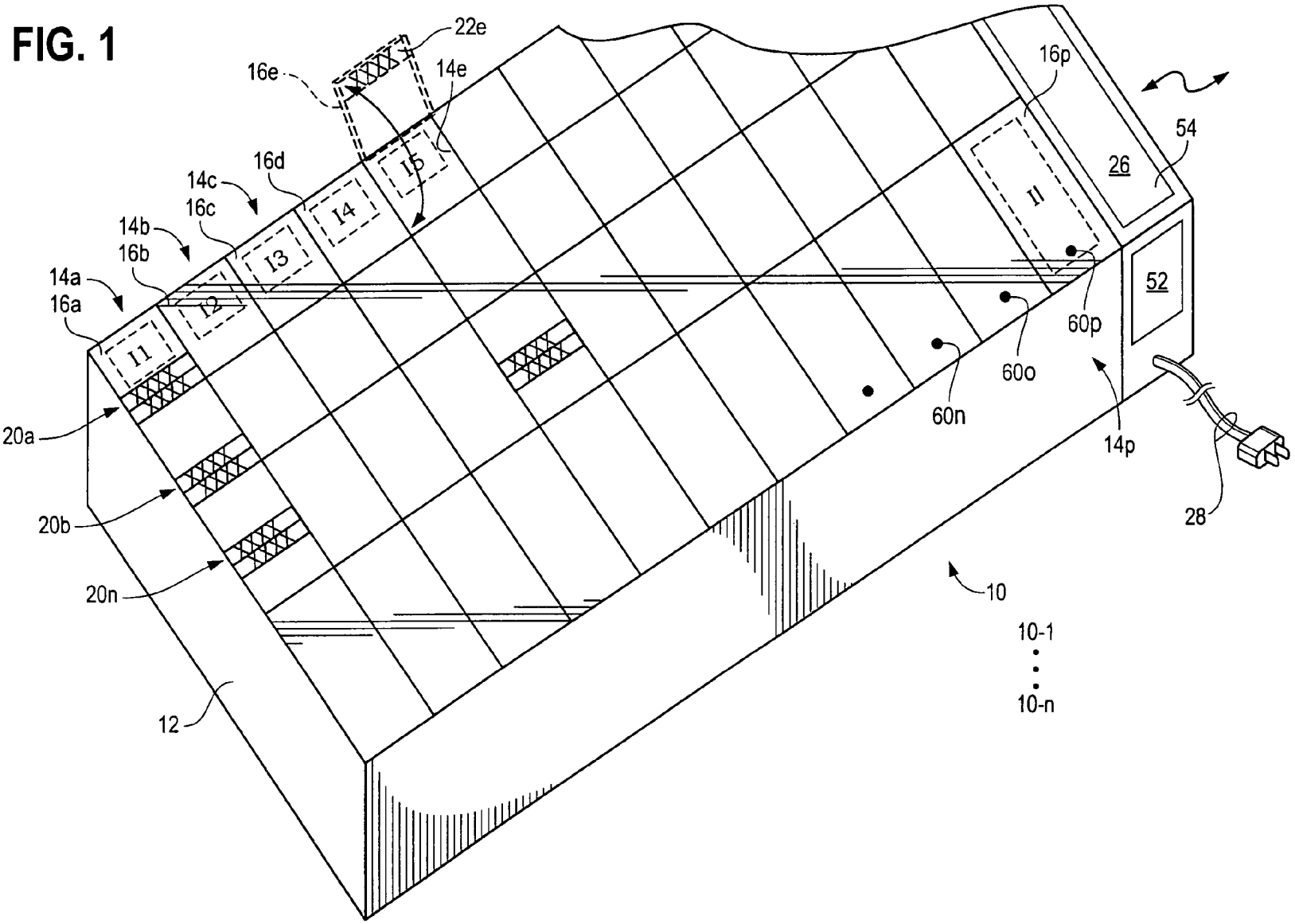
FIG. 1 is a perspective view of a product dispensing unit in accordance with the invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

A disclosed embodiment of a product delivery station incorporates a plurality of compartments for temporary storage of the respective product or products. Compartments can be associated with days of the week and/or times of the day. When the schedule calls for a product to be accessed, the accessing individual opens the appropriate compartment to obtain the product.

In a disclosed embodiment, when a compartment is opened, a signal or message can be sent, via either a wired or wireless medium, to a monitoring station indicating which compartment has been opened and the time of day. A schedule database at the monitoring station can be used to either automatically or manually compare the data received and the signal or the message to a prerecorded schedule associated with that individual. A determination can be made if the individual is operating in compliance with the schedule.

If non-compliance is detected, the individual can be contacted either in person or for example, by telephone or via the internet to check on the status and if need be provide a schedule reminder to the individual. Data can be collected at the monitoring station as to the individual's compliance or non-compliance with the pre-established schedule. Trends can be identified.

The product delivery apparatus, in a disclosed embodiment, can be periodically loaded with appropriate products, for example, on a weekly basis. Representative types of product could include tickets which are to be dispensed for a flight, such as airline tickets, prescription medications, access key cards and the like, all without limitation.

The compartments of the dispensing unit can be covered with an openable lid or member. In one embodiment, the lid or member can be held closed by a lock until access is appropriate with the predetermined schedule. Compartments are equipped with one or more sensors indicating when the compartment has been opened or accessed by an individual.

A plurality of dispensing units or stations can be in wired or wireless communication with a common monitoring system. Signals indicating product access can be communicated to the common monitoring system.

Received signals can be compared with prestored schedules to ascertain whether the individual or individuals have appropriately accessed the product or products in accordance with the prestored schedule. Optional feedback can be provided from the monitoring station to the individual or individuals inquiring as to the status thereof, whether the product is going to be accessed as expected, and/or offering suggestions or help as needed.

FIG. 1 is a perspective view of a dispensing apparatus 10 in accordance with the invention. The apparatus 10 includes a housing 12 which defines a plurality of internal containers, compartments or regions such as 14*a*, 14*b*, . . . 14*p*. Each of the internal containers or compartments is closed with a cover or lid such as 16*a*, 16*b* . . . 16*e* . . . 16*p*.

Each of the compartment covers, such as representative cover 16*e* can be opened, illustrated in phantom in FIG. 1, for access to the respective compartment. The compartments can be used to temporarily store a plurality of different products, such as I1, I2 . . . I1. It will be understood that the nature, shape, size and the like of the products are not limitations of the present invention. Representative products could include tickets, such as airline tickets, cards, such as dispensable value carrying cards or access cards, prescription medications and the like, all without limitation.

If desired, the various compartments such as 14*a, b* . . . could each carry a reminder of day and time indicia indicated generally at 20*a* . . . 20*k* . . . 20*n* all without limitation. The day and time indicia, if desired, could be color coded.

Additional indicia could be provided on an underside of the respective covers, such as indicia 22*e* of compartment 14*e*. The supplemental or additional indicia 22*e* would be viewable only when the respective container was opened, as illustrated in FIG. 1.

Figure 2:
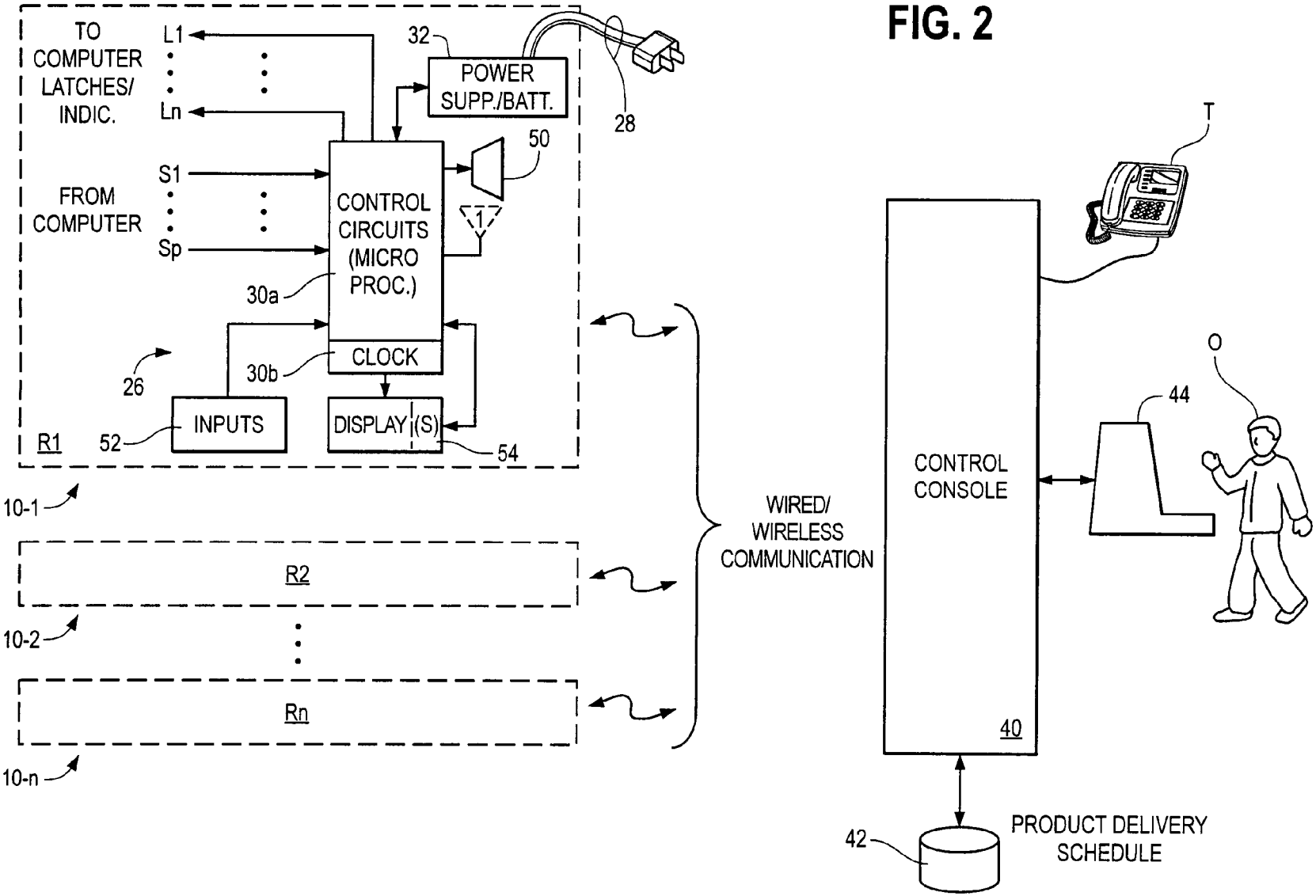
FIG. 2 is a block diagram of an electronic system which can incorporate a plurality of the dispensing units of FIG. 1.

Dispensing unit 10 includes an electronic section 26, circuitry for which is best seen in FIG. 2. The unit 10 can be energized off of utility supplied power, via cord and plug 28. The utility supplied power can be supplemented with a battery backup.

Representative circuitry 26, relative to FIG. 2, can include dispensing unit control circuitry 30*a*, which could be implemented at least in part with a processor and prestored instructions. The control circuits 30*a* can also incorporate a time and day clock 30*b* for locally checking times of access.

Each of the units 10-1, -2, *-n* (which correspond to unit 10) can also include a power supply with battery back-up 32. A plurality of optional cover latches 34 can individually release (under control of processor 32*a*) each of the covers 16 to provide access to the respective member of the plurality 14.

Each of the compartments 14*a* . . . 14*p* includes at least one cover position sensor which generates a respective output signal, S1, S2 . . . Sp, which is coupled to the control circuitry 30*a*. The signals S1 . . . Sp provide day and time information to the control circuits 30*a* as to when the respective compartment has been accessed. Access information as to when one or more of the respective compartments 14*i* has been accessed can be coupled via a wired or wireless medium to a displaced monitoring console 40. The received signals or messages can be compared to an appropriate prestored scheduled stored in a database 42.

Control software and/or circuitry at the console 40 can then provide indicia, perhaps via graphical output device 44 to an operator O as to the relationship between when the respective compartment or compartments has been accessed and the prestored schedule. Additionally, the operator O can be informed by console 40 of instances where a product was expected to be dispensed in accordance with a prestored schedule and no access signal was received from the respective dispensing unit, such as the unit 10. In such an event, the operator O can follow up either by arranging for a personal visit to the location R1 of the unit, such as the unit 10-1 or by telephone call using telephone T or a combination of both as required.

In accordance with the invention, a plurality of units 10-1, -2, *-m* (all of which are substantially identical to the unit 10 of FIG. 1) can be positioned at a plurality of locations R1, R2 . . . Rm where products are to be dispensed in accordance with pre-established schedule. The units 10-I can communicate as described above, with the control console 40.

It will be understood that neither the exact nature of the schedules stored at the database 42 nor the nature of the products being dispensed are limitations of the present invention. Additional schedules can be added via the control console 40 as needed. Obsolete schedules can be deleted in the normal course of operation.

The dispensing units, such as the dispensing unit 10, can be provided with one or more of a variety of additional features as may be convenient and desirable. For example, unit 10 could incorporate an audio output transducer, such as a speaker 50 for the purpose of enunciating prestored or prerecorded reminder or alert messages. These could include, without limitation, a message that it is an appropriate day and time to access a product from one of the containers and/or one or more confirmatory responses indicating that the appropriate compartment has been accessed at an appropriate day and time in accordance with a pre-stored schedule. The control circuits 30*a* can incorporate storage for the purpose of storing one or more product delivery schedules as might be convenient and desirable. Such schedules could be downloaded, for example, from control console 40 or could be entered locally if desired. Unit 10 could also include speech synthesis circuitry as would be understood by those of skill in the art.

Unit 10 could also incorporate a plurality of inputs 52 which could include manual means to control the volume of any audible outputs from speaker 50, a microphone for recording one or more reminder and/or confirmatory messages, a switch or keyboard or other form of manually operable input device to disable the audible outputted messages, set the unit 10 for recording messages or schedules or the like, all without limitation.

One of more visual displays 54 can be carried on unit 10 for providing a time of day and day of the week output off of clock 30*b*, light emitting diodes or other visual indicators as to status, for example, that it is time and an appropriate date to open a container. If desired, the number of the appropriate container could also be presented on display 54 as an aid to the person using the unit 10. The control circuits 30*a* could also provide control signals to a plurality of light emitting diodes or other output indicators 60*a,b* . . . *p* associated with respective containers to illuminate an indicator identifying a compartment or a container to be opened.

Additionally, control circuits 30*a* could detect, based on inputs from sensors S1 . . . Sp, when unit 10 has dispensed all of the prestored product and it is necessary to refill same. Appropriate messages can be forwarded to control console 40 in this regard. Additional features can be added, all without limitation.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modification as fall with the scope of the claims.

What is claimed is:

1. An apparatus comprising:

at least one storage device which includes a unitary housing having a substantially planar structure that bounds an interior region, at least in part, with the interior region divided into a plurality of fixedly arranged, non-separable product containers;

wherein each product container defines a smaller interior region for product storage and each product container is closeable by a separate securable cover and has a separate electronically actuatable cover latch and when closed, each cover has an interior surface adjacent to the respective interior region;

sensors, associated with at least some of the containers for responding to access to the respective containers and for emitting a signal indicative thereof;

control circuitry coupled to the cover latches, the circuitry unlocking various cover latches in accordance with a predetermined, pre-stored schedule where when the latch associated with a respective cover is unlocked, the cover is rotatable to an open position which exposes the interior surface and supplemental indicia carried on the interior surface of the respective cover; and an interface for communicating representations of the signals to a displaced site.

2. An apparatus as in claim 1 which emits a reminder indicium associated with access of a respective one of the product containers.

3. An apparatus as in claim 2 which includes day specifying indicia associated with respective of the containers.

4. An apparatus as in claim 2 where the interface comprises circuitry for at least one of, transmitting the signals, at least in part, via a wireless medium, or, transmitting the signals, at least in part, via a wired medium.

5. An apparatus as in claim 2 where the interface includes circuitry for emitting a local reminder relative to accessing at least some of the containers.

6. An apparatus as in claim 5 which carries day identifying indicia associated with respective ones of the containers.

7. An apparatus as in claim 1 where the communicated representations include an indicium indicative of time of access to the respective container.

8. An apparatus as in claim 1 including a plurality of separate storage devices and a common displaced monitoring unit to provide dispensing schedules.

9. An apparatus as in claim 8 where some of the storage devices have common walls.

10. An apparatus as in claim 8 where each storage device has only one moveable cover.

11. A product dispenser comprising:

an elongated housing having a generally rectangular cross-section, the housing being subdivided into a plurality of separate integrally formed product containers with each of the containers bonded by a plurality of non-movable side walls, non-movable end walls and a movable cover with the walls and cover defining an empty product receiving region where the cover has an indicia carrying surface adjacent to the product receiving region when closed;

a plurality of electrically activated latches, a latch is associated with respective cover and retains the cover in a closed position, locked against the sidewalls until activated which unlocks the cover for movement from the closed position to an open position with the product receiving region being accessible and where the surface and the indicia carried on the surface are visible only when the cover is in the open position;

a plurality of sensors, each sensor has an output port, a sensor is associated with each of the latches to generate a signal at the port, indicative of the respective cover moving to the open position; and control circuits coupled to the latches and sensor output ports, the control circuits including storage for at least one product dispensing schedule, the latches being activated in accordance with the at least one product dispensing schedule, and responsive to signals from the sensors, initiating a communication with a displaced control console indicative of product having been dispensed and that a refill is needed of at least some of the containers.

12. A dispenser as in claim 11 which includes an antenna for wireless communication with the control console.

13. A dispenser as in claim 11 where the control console maintains a plurality of different product dispensing schedules.

14. A dispenser as in claim 11 where the control console downloads at least one product dispensing schedule to the control circuits.

15. A dispenser as in claim 14 where the control circuits include storage circuits to store downloaded product dispensing schedules.

16. A dispenser as in claim 15 which includes an antenna for wireless communication with the control console.

17. A method for dispensing a product comprising:

inputting a dispensing schedule into or selecting a pre-stored dispensing schedule of a dispenser having an elongated housing having a generally rectangular cross-section, the housing being subdivided into a plurality of separate integrally formed product containers with each of the containers bonded by a plurality of non-movable side walls, non-movable end walls and a movable cover with the walls and cover defining an empty product receiving region;

a plurality of electrically activated latches, a latch is associated with respective cover and retains the cover in a closed position, locked against the sidewalls until activated which unlocks the cover for movement from the closed position to an open position with the product receiving region being accessible;

a plurality of sensors, each sensor has an output port, a sensor is associated with each of the latches to generate a signal at the port, indicative of the respective cover moving to the open position; and control circuits coupled to the latches and sensor output ports, the control circuits including storage for at least one product dispensing schedule, the latches being activated in accordance with the at least one product dispensing schedule, and responsive to signals from the sensors, initiating a communication with a displaced control console indicative of product having been dispensed and that a refill is needed of at least some of the containers;

placing a predetermined amount of product into at least one product container;

moving the cover of the product container from the open position to the closed position wherein the latch associated with the cover retains the cover in the closed position;

pursuant to the dispensing schedule, the control circuit sending a signal to the appropriate latch which causes the latch to unlock the cover;

moving the unlocked cover from the closed position to the open position thereby exposing the product in the container for removal; and removing all of the product from the open product container at the same time.

* * * * *